US008048841B2

(12) United States Patent
Aihara et al.

(10) Patent No.: US 8,048,841 B2
(45) Date of Patent: Nov. 1, 2011

(54) SPRAY-TYPE BLEACHING AGENT

(75) Inventors: Shin Aihara, Wakayama (JP); Yoshiyuki Watanabe, Wakayama (JP); Yosuke Komatsu, Wakayama (JP); Masafumi Shioji, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 12/666,744

(22) PCT Filed: Jun. 26, 2008

(86) PCT No.: PCT/JP2008/062031

§ 371 (c)(1),
(2), (4) Date: Feb. 3, 2010

(87) PCT Pub. No.: WO2009/001966

PCT Pub. Date: Dec. 31, 2008

(65) Prior Publication Data

US 2010/0193735 A1 Aug. 5, 2010

(30) Foreign Application Priority Data

Jun. 27, 2007 (JP) ..... 2007-168531

(51) Int. Cl.
*C11D 17/00* (2006.01)

(52) U.S. Cl. ..... 510/392; 510/294; 510/447

(58) Field of Classification Search ..... 510/294, 510/392, 447
See application file for complete search history.

(56) References Cited

U.S. PATENT DOCUMENTS

| | | | | |
|---|---|---|---|---|
| 6,482,791 | B2 * | 11/2002 | Sano et al. | 510/380 |
| 2005/0065055 | A1 * | 3/2005 | Barnes | 510/421 |

FOREIGN PATENT DOCUMENTS

| | | | |
|---|---|---|---|
| JP | 7-305099 | A | 11/1995 |
| JP | 2002-241791 | A | 8/2002 |
| JP | 2002-256289 | A | 9/2002 |
| JP | 2003-41300 | A | 2/2003 |
| JP | 2003-253297 | A | 9/2003 |
| JP | 2004-149678 | A | 5/2004 |
| JP | 2007-137930 | A | 6/2007 |
| JP | 2007-177092 | A | 7/2007 |

OTHER PUBLICATIONS

Chinese Office Action, dated Mar. 28, 2011, for Chinese Application No. 200880018388.0.
English language machine generated translation of JP-7-305099-A, dated Nov. 21, 1995.

* cited by examiner

*Primary Examiner* — Gregory Webb
(74) *Attorney, Agent, or Firm* — Birch, Stewart, Kolasch & Birch, LLP

(57) ABSTRACT

The present invention is a spray mold remover, prepared by filling a bleaching composition in a container having a spraying means, the bleaching composition containing (a) an alkali metal hypochlorite, (b) a cationic surfactant and (c) a compound represented by the formula (1):

$$X^1—O(AO)_n—X^2 \quad (1)$$

wherein, AO represents an alkyleneoxy group having 2 to 4 carbon atoms; n represents an average addition mole number of the alkyleneoxy group ranging from 5 to 150; $X^1$ and $X^2$ each represent a hydrogen atom, $—SO_3M$, $—CH_2COOM$ (M represents an alkali metal atom), or an alkyl group having 1 to 6 carbon atoms, with the proviso that $X^1$ and $X^2$ do not represent hydrogen atoms or alkyl groups at the same time.

6 Claims, No Drawings

SPRAY-TYPE BLEACHING AGENT

FIELD OF THE INVENTION

The present invention relates to a spray mold remover, and more particularly a spray mold remover suitably used for hard surface.

BACKGROUND OF THE INVENTION

There have been known many bleaching compositions containing alkali metal hypochlorites as a main component. These compositions are widely used to remove stains, particularly mildew stains, on a hard surface of a bathroom, a bathtub, a kitchen, a drain, and the like. Such a bleaching composition is applied to various hard surfaces including a vertical and an inclined planes in addition to a horizontal plane, and thus required to have retention properties to a target stain in order to exhibit good bleaching performance in any case of being applied to any surface. To satisfy the requirement, many methods for improving retention properties of a bleaching composition have been attempted. For example, JP-A 2003-41300 discloses a detergent product having increased retention properties by providing viscosity to a composition. JP-A 2003-253297 discloses a detergent and a detergent product, that detergent has thixotropic nature and relatively high viscosity, and adheres and uniformly covers the surface of a cleaning target even when it has a net structure without passing through the net by being sprayed in the form of foam having adequate roughness with a sprayer, and thereby the detergent can exhibit good retention properties. JP-A 7-305099 discloses a bleaching composition containing a specific polymer and having good storage stability.

Recently, there are increasing cases of mold growing on resin parts such as silicone resin caulking parts and soft poly (vinyl chloride) resin packing parts used in a joint between a wall and a bathtub and the like in addition to tiles and joints. Although conventional chlorine-based bleaching detergents exhibits sufficient effects on stains of tile and joint and other dark stains, these have not so good bleaching detergency to mildew stains generated on these resin parts. There is thus a need for a bleaching composition having excellent bleaching detergency to mildew stains on resin parts. To meet the need, many methods for increasing bleaching performance to mildew stains on resin parts are studied. JP-A 2002-241791 and JP-A 2002-256289 disclose liquid bleaching detergent compositions containing quaternary ammonium surfactants.

SUMMARY OF THE INVENTION

The present invention relates to a spray mold remover, prepared by filling a bleaching composition (hereinafter, also referred to as the bleaching composition of the present invention) in a container having a spraying means, the bleaching composition containing (a) an alkali metal hypochlorite [hereinafter, referred to as component (a)], (b) a cationic surfactant [hereinafter, referred to as component (b)], (c) a compound represented by the formula (1) [hereinafter, referred to as component (c)]:

$$X^1—O(AO)_n—X^2 \quad (1)$$

wherein, AO represents an alkyleneoxy group having 2 to 4 carbon atoms; n represents an average addition mole number of the alkyleneoxy group ranging from 5 to 150; $X^1$ and $X^2$ each represent a hydrogen atom, $—SO_3M$, $—CH_2COOM$ (M represents an alkali metal atom), or an alkyl group having 1 to 6 carbon atoms, with the proviso that $X^1$ and $X^2$ do not represent hydrogen atoms or alkyl groups at the same time.

The present invention is a combination of the bleaching composition filled in a container and the container having a spraying means. The present invention also relates to use of the bleaching composition as a bleach by spraying it from the container having a spraying means in which the composition is filled.

DETAILED DESCRIPTION OF THE INVENTION

For the detergent product of JP-A 2003-41300, although the composition has increased retention properties, it cannot be foamed when sprayed with a trigger-type sprayer, and is inferior in usability and visibility. For the detergent and the detergent product of JP-A 2003-253297, although the detergent has increased retention properties, it forms rough foam and is inferior in visibility and usability. JP-A 7-305099 describes the bleaching composition that has good storage stability of the alkali metal hypochlorite, but does not describe a state of the composition when sprayed with a trigger-type sprayer and not suggest a specific means for providing creamy lather having good retention properties to a target plane. Liquid bleaching compositions of JP-A 2002-241791 and JP-A 2002-256289 have good bleaching properties to mold glowing on resin parts but also often have trouble forming foam having good retention properties.

Therefore, there is a need for a spray mold remover that forms creamy lather by being sprayed with a trigger-type sprayer and the like and has high retention properties to exhibit excellent bleaching performance to mildew stains glowing on caulking and packing parts.

According to the present invention, a spray mold remover can be prepared, that forms creamy lather by being sprayed with a trigger-type sprayer and the like and has high retention properties to exhibit excellent bleaching performance to mildew stains glowing on caulking and packing parts.

[Component (a)]

The bleaching composition of the present invention contains an alkali metal hypochlorite as the component (a). Examples of the component (a) include sodium hypochlorite and potassium hypochlorite. Sodium hypochlorite is particularly preferred. Sodium hypochlorite contains an equimolar amount of sodium chloride due to producing reasons. In some cases, sodium hypochlorite containing much amount of sodium chloride decreases its storage stability. Sodium hypochlorite is preferably decreased a content of sodium chloride to be used. More specifically, an amount of sodium chloride is preferably 10 to 60% by mol, and more preferably 10 to 40% by mol to sodium hypochlorite. Such sodium hypochlorite containing a decreased amount of sodium chloride is commercially available as sodium hypochlorite with low levels of salt. A content of the component (a) in the bleaching composition of the present invention is preferably 0.1 to 5% by mass, more preferably 0.5 to 4% by mass, and even more preferably 1 to 3% by mass. The bleaching composition containing 0.1% by mass or more of the component (a) has sufficient bleaching power. The bleaching composition containing 5% by mass or less of the component (a) has good stability of the alkali metal hypochlorite.

[Component (b)]

The bleaching composition of the present invention contains a cationic surfactant as the component (b). In the present invention, preferably used is a cationic surfactant represented by the formula (2):

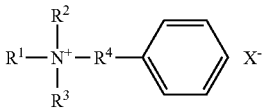

(2)

wherein, $R^1$ represents an alkyl group having 6 to 12 carbon atoms, and preferably 8 to 10 carbon atoms; $R^2$ and $R^3$ each independently represent an alkyl group having 1 to 3 carbon atoms, preferably 1 or 2 carbon atoms, and more preferably a methyl group; $R^4$ represents an alkylene group having 1 to 3 carbon atoms, and preferably a methylene group; and $X^-$ represents a counter ion, and preferably a chloride ion.

From the viewpoint of achieving high bleaching effects on mildew stains glowing on caulking and packing parts, a content of the component (b) in the bleaching composition of the present invention is preferably 0.05 to 1% by mass, more preferably 0.1 to 0.5% by mass, and even more preferably 0.1 to 0.3% by mass.

[Component (c)]

The bleaching composition of the present invention contains a compound represented by the formula (1) as the component (c). The component (c) used may be a single compound or a mixture of compounds. The bleaching composition containing the component (c) can have further an increased foaming power and creamy lather particularly when sprayed with a trigger-type sprayer.

$$X^1—O(AO)_n—X^2 \quad (1)$$

wherein, AO represents an alkyleneoxy group having 2 to 4 carbon atoms; n represents an average addition mole number of the alkyleneoxy group ranging from 5 to 150; $X^1$ and $X^2$ each represents a hydrogen atom, $—SO_3M$, $—CH_2COOM$ (M represents an alkali metal atom), or an alkyl group having 1 to 6 carbon atoms, with the proviso that $X^1$ and $X^2$ do not represent hydrogen atoms or alkyl groups at the same time.

In the compound represented by the formula (1), AO represents an alkyleneoxy group having 2 to 4 carbon atoms, preferably an ethyleneoxy group or a propyleneoxy group, and particularly preferably an ethyleneoxy group. n represents an average addition mole number of the alkyleneoxy group ranging from 5 to 150, preferably from 10 to 100, and more preferably from 10 to 40. When the average addition mole number of the alkyleneoxy group is 5 or more, the bleaching composition has good retention properties, and when 150 or less, the bleaching composition has good stability such as prevention of clouding of the composition. $X^1$ and $X^2$ each represents a hydrogen atom, $—SO_3M$, $—CH_2COOM$ (M represents an alkali metal atom), or an alkyl group having 1 to 6 carbon atoms, with the proviso that $X^1$ and $X^2$ at both ends do not represent hydrogen atoms or alkyl groups at the same time. From the viewpoint of stability of the alkali metal hypochlorite, $X^1$ and $X^2$ at both ends preferably represent sulfuric acid groups or alkali metal sulfate groups, and particularly preferably each represent $—SO_3M$ (M represents an alkali metal atom).

A content of the component (c) in the bleaching composition of the present invention is preferably 0.05 to 3% by mass, more preferably 0.05 to 2% by mass, and even more preferably 0.05 to 1% by mass. The bleaching composition containing 0.05% by mass or more of the component (c) has good foaming power. The bleaching composition containing 3% by mass or less of the component (c) has good stability of the alkali metal hypochlorite.

From the viewpoint of achieving high bleaching effects on mildew stains glowing on caulking and packing parts, a molar ratio of the component (c) to the component (b) in the bleaching composition of the present invention, as represented by (c)/(b), (when the component (c) has two $—SO_3M$ or $—CH_2COOM$ groups as $X^1$ and $X^2$, the mole number of the compound is multiplied by 2) is preferably 2 or less, more preferably 1 or less, and even more preferably 0.5 or less. From the foaming properties in spraying, the molar ratio (c)/(b) is preferably more than 0, more preferably 0.001 or more, even more preferably 0.01 or more, even more preferably 0.1 or more, and even more preferably 0.15 or more.

[Component (d)]

The bleaching composition of the present invention can contain a tertiary amine oxide represented by the formula (3) as the component (d):

$$R^5R^6R^7N \rightarrow O \quad (3)$$

wherein, $R^5$ represents a linear or branched alkyl group having 8 to 20 carbon atoms; and $R^6$ and $R^7$ each represent a linear or branched alkyl group having 1 to 3 carbon atoms.

Specific examples of the component (d) are as follows. Examples of the alkyl group having 8 to 20 carbon atoms as $R^5$ include an octyl, a decyl, a dodecyl, a tetradecyl, a hexadecyl, and an octadecyl groups. Among these groups, particularly preferred are a decyl, a dodecyl, a tetradecyl, and a hexadecyl groups. The component (d) may be a mixture of tertiary amine oxides having alkyl groups having different carbon atoms derived from naturally-occurred substances. Examples of the alkyl group having 1 to 3 carbon atoms as $R^6$ or $R^7$ include a methyl, an ethyl, and a propyl groups. Among these groups, particularly preferred is a methyl group.

A content of the component (d) in the bleaching composition of the present invention is preferably 0.1 to 5% by mass, more preferably 0.1 to 3% by mass, and even more preferably 0.1 to 1% by mass. The bleaching composition containing 0.1% by mass or more of the component (d) has good detergency. The bleaching composition containing 5% by mass or less of the component (d) has an intended viscosity.

The bleaching composition containing the compound in which $R^5$ represents an alkyl group having 14 or more carbon atoms forms finer foams when sprayed with a trigger-type sprayer to provide good usability.

[Component (e)]

The bleaching composition of the present invention can contain a hydrotrope agent having a benzene ring as a component (e). Examples of the component (e) include xylenesulfonic acid, toluenesulfonic acid, cumenesulfonic acid, benzoic acid, and alkali metal salts thereof. Among them, particularly preferred are m-xylenesulfonic acid and alkali metal salts thereof.

From the viewpoint of control of viscosity and further an increased foaming power and creamy lather when sprayed with a trigger-type sprayer, a content of the component (e) in the bleaching composition of the present invention is preferably 0.1 to 5% by mass, more preferably 0.1 to 3% by mass, and even more preferably 0.1 to 1% by mass. The bleaching composition containing 0.1% by mass or more of the component (e) has foaming power. The bleaching composition containing 5% by mass or less of the component (e) has a controlled viscosity within the intended range.

[Component (f)]

The bleaching composition of the present invention can contain a compound represented by the formula (4) as a component (f):

$$R^{11}COOM \quad (4)$$

wherein, represents a linear or branched alkyl group having 6 to 22 carbon atoms; and M represents a hydrogen, an alkali metal atom or an alkaline earth metal atom.

For the fatty acid represented by the formula (4) or a salt thereof (which has a linear or branched alkyl group having 6 to 22 carbon atoms), preferred are alkali metal salts of fatty acids having a linear alkyl group having 6 to 22 carbon atoms as $R^{11}$. Examples thereof include sodium and potassium salts of linear fatty acids such as capric acid, lauric acid, myristic acid, palmitic acid, and stearic acid. From the viewpoint of stability in low temperature storage, the fatty acid preferably a mixture of those having different alkyl groups, and particularly, more preferably a mixture of fatty acids having alkyl groups of 10 to 16 carbon atoms in which a fatty acid having an alkyl group of 12 carbon atoms accounts for 30% or more of the total fatty acids. A mixture of fatty acids in which a mass ratio of a fatty acid having 10 carbon atoms ($f_{c10}$) to a fatty acid having 12 carbon atoms ($f_{c12}$) is $(f_{c10})/(f_{c12})=2/1$ to 1/2 can balance low temperature stability with adhesion properties.

A content of the component (f) in the bleaching composition of the present invention is preferably 0.1 to 5% by mass, more preferably 0.1 to 3% by mass, and even more preferably 0.1 to 1% by mass. The bleaching composition containing 0.1% by mass or more of the component (f) has detergency. The bleaching composition containing 5% by mass or less of the component (f) has an intended viscosity and forms good foam when sprayed.

[Component (g)]

The bleaching composition of the present invention can contain an alkali metal hydroxide as a component (g).

Examples of the component (g) include sodium hydroxide and potassium hydroxide. Sodium hydroxide is particularly preferred. The component (g) is preferably used as a component increasing stability of the alkali metal hypochlorite of the component (a). A content of the component (g) in the bleaching composition of the present invention is preferably 0.1 to 1% by mass, more preferably 0.2 to 0.8% by mass, and even more preferably 0.3 to 0.7% by mass. The bleaching composition containing 0.1% by mass or more of the component (g) has good stability of the alkali metal hypochlorite. The bleaching composition containing 1% by mass or less of the component (g) has good bleaching performance.

[Other Component]

The bleaching composition of the present invention can contain a perfume as an optional component. Examples of the perfume that can be used in a hypochlorite composition include those described in JP-A 50-74581 and JP-A 62-205200. The perfume may be a single perfume or a mixture of perfumes. The perfume is generally contained in the bleaching composition in an amount of 0.001 to 0.5% by mass. The perfume may affect on stability of the composition, and thus requires careful selection of composition and content.

The bleaching composition of the present invention can contain a surfactant other than the cationic surfactant of the component (b) or the tertiary amine oxide of the component (d) or the compound represented by the formula (4) of the component (f) as an optional component. Examples of the optional surfactant include anionic, nonionic, and amphoteric surfactants. Among these surfactants, preferably used are anionic surfactants. Specific examples thereof include a compound represented by the formula (5):

$$R^{12}O(AO)_nR^{13}COOM \quad (5)$$

wherein, $R^{12}$ represents a linear or branched alkyl group having 6 to 22 carbon atoms; A represents one or two or more of alkylene groups being linear or branched and having 2 to 4 carbon atoms; $R^{13}$ represents an alkylene group having 1 to 4 carbon atoms. n represents an average addition mole number ranging from 0 to 100; and M represents a hydrogen, an alkali metal or an alkaline earth metal atom.

For the polyoxyalkylene alkyl ether carboxylate represented by the formula (5) (having a linear or branched alkyl group having 6 to 22 carbon atoms), examples of the linear or branched alkyl group having 6 to 22 carbon atoms as $R^{12}$ include a hexyl, an octyl, a decyl, a dodecyl, a tetradecyl, a hexadecyl, and an octadecyl groups. Particularly preferred are a dodecyl and a tetradecyl groups. The linear or branched alkylene group having 1 to 4 carbon atoms as A preferably has 2 to 4 carbon atoms. Examples thereof include an ethylene, a propylene, an isopropylene, and a butylene groups. Particularly preferred are an ethylene and an isopropylene groups. Examples of the linear or branched alkylene group having 1 to 4 carbon atoms as $R^{13}$ include a methylene, a propylene, an isopropylene, and a butylene groups. Particularly preferred are a methylene, a propylene, and an isopropylene groups. Examples of the alkali metal atom as M in the formula (5) include a sodium salt and a potassium atom. Particularly preferred is a sodium atom. Examples of the alkaline earth metal atom include calcium and magnesium. n in the formula (5) represents an average addition mole number, and is preferably in the range of 1 to 50, and more preferably 1 to 20.

Specific examples of the compound represented by the formula (5) include sodium polyoxyethylene hexyl ether acetate (n=3.8), sodium polyoxyethylene octyl ether acetate (n=4.5), sodium polyoxyethylene dodecyl ether acetate (n=10), sodium polyoxyethylene dodecyl ether acetate (n=2), sodium polyoxypropylene dodecyl ether acetate (n=6). From the viewpoint of production cost, these are preferably used as a mixture such as a mixture of sodium polyoxyethylene alkyl (linear or branched chain having 8 to 10 carbon atoms) ether acetate (n=1 to 20). In this context, n represents an average addition mole number of ethylene oxide.

The bleaching composition of the present invention is in the liquid state, and contains water making up the rest. From the viewpoint of storage stability, deionized water and distilled water from which a trace amount of impurities such as metal ions is removed are preferably used. From the viewpoint of storage stability, a content of water is preferably 80 to 98% by mass, and more preferably 90 to 98% by mass of the composition. From the points of storage stability and bleaching effect, pH of the composition at 20° C. is preferably controlled to 12.5 to 13.5.

From the viewpoint of retention properties to various target planes including vertical and inclined planes, the bleaching composition of the present invention is preferably imparted viscosity properties. A viscosity (a value measured after 60 seconds rotation with a B-type viscometer under conditions of 20° C., rotor No. 1, 60 rpm) is preferably 5 to 100 mPa·s, more preferably 5 to 50 mPa·s, and even more preferably to 30 mPa·s.

The bleaching composition of the present invention is used in the form of a spray mold remover filled in a container equipped with a spraying means. From the viewpoints of simplicity and foaming properties, a preferred embodiment is a bleach in a spraying container prepared by filling the composition in the spraying container. The spraying means is preferably a trigger-type spray that can spray the bleaching composition containing components (a) to (c) in a foam state, and more specifically a trigger having a system of discharging 0.5 to 2 mL of composition and forming foam thereof (foaming system) at one action. When the bleaching composition of the present invention is used, it is preferably sprayed in an amount of 5 to 15 g per square meter of a target.

The foaming system preferably includes a spin element and a liquid-passing plate having a round opening of 4 to 8 mm diameter and several rod-shaped projections arranged in the opening. The spin element is a structure providing a spinning motion to a liquid flow passing therethrough and sending away from a nozzle at the last. A detailed construction thereof can be seen, for example, in JP-A 8-332422, FIG. 4(b) in JP-A 8-108102, and FIG. 1 in JP-A 2002-68265.

The liquid-passing plate, that is the other member of the foaming system, has a round opening of 5 to 7 mm diameter and rod-shaped projections, preferably 3 to 8 in the number, arranged in the opening. Seeing the liquid-passing plate as a plane surface, the rod-shaped projection is preferably in a rectangle shape having a width of 0.8 to 1.2 mm and a length of 2 to 4 mm. An area occupied with the rod-shaped projections to an area of the opening excluding the projections is preferably 30 to 90% by area, more preferably 40 to 80% by area, and even more preferably 40 to 70% by area. Installation of such a liquid-passing plate provides foam having good retention properties to a vertical plane.

As a container used for the bleach in the spray container of the present invention, those commonly used can be used. For example, a container made of polyethylene and molded by blowing can be used. A thickness of the container may be varied between the bottom and the side, and is 0.05 to 3.0 mm. A volume of the container is 200 to 1000 mL. When the hypochlorite as the component (a) is contained, to prevent decomposition thereof by light, the container is opaque. To opacify the container, a material containing titanium oxide and the like is used. In this case, the container has a multilayer structure, and specifically the innermost layer, being in contact with the liquid bleaching composition, is made of a material free from metal. An amount of the liquid bleaching composition filled in the container is preferably 200 to 700 ml for ease of handling.

EXAMPLES

The following Examples demonstrate the present invention. Examples are intended to illustrate the present invention and not to limit the present invention.

Liquid bleaching compositions shown in Tables 1 to 3 were prepared. These compositions were evaluated for retention properties of foam, storage stability, bleaching performance, viscosity, and initial foam volume according to the following methods. Results are shown in Tables 1 to 3.

Evaluation for Retention Properties of Foam

A liquid bleaching composition was sprayed to a wall of a bathroom tiled with 10 cm by 10 cm ceramics four times in a horizontal direction along with a joint from 10 cm away in the area of 10 cm width with a trigger of Kabitori Haiter (spray amount: 1 ml/action, manufactured by Kao Corporation). An area defined by a position to which foam was attached and a position of the foam flowing down for 1 minute was calculated. The smaller value means the higher retention properties. Although a difference was small in numerical description, there was significant difference visually.

Confirmation of Storage Stability 100 mL of liquid bleaching composition was stationary stored for one month at −5° C. and visually evaluated for its appearance based on the following criteria.

(Evaluation Criteria)

1: uniform transparent liquid without change such as separation.

2: non-uniform liquid generating clouding, separation, deposition, or the like.

Evaluation for Bleaching Performance

On a soft poly(vinyl chloride) resin used for packing a bathroom door of a general house, a mold was grown under practical conditions. A test piece was taken therefrom and cut into a size of about 1 cm to prepare evaluation samples. Evaluation samples were measured for lightness (L value) with a colorimetric color difference meter (manufactured by Nippon Denshoku Industries Co., Ltd, ND-300A) and selected such that a variation of L value was within ±2 to be evaluated. To a surface on which a mold growing set in a vertical direction, 1 mL of liquid bleaching composition was sprayed in a foam state with a trigger of Kabitori Haiter (spray amount: 1 g/action, manufactured by Kao Corporation). The evaluation sample was allowed to stand for 20 minutes, and washed with water, dried in the air, and bleached. A lightness (L value) of the evaluation sample after the treatment was measured. A difference of lightness between before and after the treatment was considered as a bleaching performance. The larger difference of L value means the higher bleaching effect.

Measurement of Viscosity

A liquid bleaching composition was measured with a B-type viscometer (manufactured by Tokimec) at 20° C. initial foam volume A liquid bleaching composition was sprayed in a 200 mL measuring cylinder ten times with a trigger of Kabitori Haiter (spray amount: 1 g/action, manufactured by Kao Corporation). The resultant foam was measured for its volume (mL). The sprayed amount (g) was also weighed with a scale to two places of decimals. An initial foam volume was calculated with a calculation formula, initial foam volume (mL/g)=volume of foam (mL)/amount sprayed (g). The larger value means the better effects for use and visibility.

TABLE 1

| | | | | Example | | | Comparative example |
|---|---|---|---|---|---|---|---|
| | | | | 1 | 2 | 3 | 1 |
| Liquid bleaching composition | Composition (% by mass) | (a) | Sodium hypochlorite | 2.5 | 2.5 | 2.5 | 2.5 |
| | | (b) | Octyl dimethyl benzyl ammonium chloride | 0.1 | 0.1 | 0.1 | — |
| | | (c) | Compound 1 | 0.2 | 0.5 | 1.0 | — |
| | | (d) | Dodecyl dimethyl amide oxide | 1.0 | 1.0 | 1.0 | — |
| | | (g) | Sodium hydroxide | 0.5 | 0.5 | 0.5 | 0.5 |
| | | Water | | Balance | Balance | Balance | Balance |
| | | Total | | 100 | 100 | 100 | 100 |
| | Molar ratio of (c)/(b) | | | 0.65 | 1.63 | 3.25 | — |
| Bleaching performance | | | | 10 | 8 | 6 | 5 |

TABLE 2

| | | | | Example | | | | |
|---|---|---|---|---|---|---|---|---|
| | | | | 4 | 5 | 6 | 7 | 8 |
| Liquid bleaching composition | Composition (% by mass) | (a) | Sodium hypochlorite | 2.5 | 2.5 | 2.5 | 2.5 | 2.5 |
| | | (b) | Octyl dimethyl benzyl ammonium chloride | 0.3 | 0.3 | 0.3 | 0.2 | 0.3 |
| | | (c) | Compound 1 | 0.2 | 0.2 | 0.2 | 0.2 | 0.3 |
| | | (d) | Tetradecyl dimethyl amine oxide | 0.6 | 0.6 | 0.6 | 0.5 | 0.8 |
| | | (e) | m-xylenesulfonic acid | 0.3 | 0.3 | 0.3 | 0.2 | 0.3 |
| | | (f) | Capric acid | 0.4 | 0.1 | 0.4 | 0.2 | 0.35 |
| | | | Lauric acid | 0.4 | 0.7 | — | 0.2 | 0.35 |
| | | | Myristic acid | 0.1 | 0.1 | — | — | 0.05 |
| | | (g) | Sodium hydroxide | 0.5 | 0.5 | 0.5 | 0.5 | 0.5 |
| | | | Water | Balance | Balance | Balance | Balance | Balance |
| | | | Total | 100 | 100 | 100 | 100 | 100 |
| | Molar ratio of (c)/(b) | | | 0.22 | 0.22 | 0.22 | 0.33 | 0.49 |
| Viscosity (mPa · s/20° C.) | | | | 7 | 20 | 4 | 8 | 9 |
| Retention properties of foam ($cm^2$) | | | | 250 | 180 | 400 or more | 220 | 200 |
| Storage stability | | | | 1 | 2 | 1 | 1 | 1 |
| Bleaching performance | | | | 11 | 11 | 11 | 10 | 11 |

TABLE 3

| | | | | Example | | Comparative example | |
|---|---|---|---|---|---|---|---|
| | | | | 9 | 10 | 2 | 3 |
| Liquid bleaching composition | Composition (% by mass) | (a) | Sodium hypochlorite | 2.5 | 2.5 | 2.5 | 2.5 |
| | | (b) | Octyl dimethyl benzyl ammonium chloride | 0.3 | 0.3 | 0.3 | — |
| | | (c) | Compound 1 | 0.2 | 0.2 | — | 0.2 |
| | | (d) | Tetradecyl dimethyl amine oxide | 0.6 | 0.6 | 0.6 | 0.6 |
| | | (e) | m-xylenesulfonic acid | 0.2 | — | 0.2 | 0.2 |
| | | (f) | Capric acid | 0.4 | 0.4 | 0.4 | 0.4 |
| | | | Lauric acid | 0.4 | 0.4 | 0.4 | 0.4 |
| | | | Myristic acid | 0.1 | 0.1 | 0.1 | 0.1 |
| | | (g) | Sodium hydroxide | 0.5 | 0.5 | 0.5 | 0.5 |
| | | | Water | Balance | Balance | Balance | Balance |
| | | | Total | 100 | 100 | 100 | 100 |
| | Molar ratio of (c)/(b) | | | 0.22 | 0.22 | 0 | — |
| Viscosity (mPa · s/20° C.) | | | | 8 | 11 | 8 | 8 |
| Initial foam volume | | | | 11 | 8 | 7 | 11 |
| Bleaching performance | | | | 11 | 11 | 8 | 6 |

* compound 1: a sample prepared by reacting polyoxyethylene glycol 1540 [corresponding to a compound of the formula (1), wherein, AO is an alkyleneoxy group having two carbon atoms, n is 35, and $X^1$ and $X^2$ each represent a hydrogen atom, manufactured by Sanyo Chemical Industries, Ltd.] with two molar amount of sulfuric anhydride and neutralizing with sodium hydroxide in a solvent [a molar ratio of mono-substituted with sulfuric acid to di-substituted with sulfuric acid is mono/di = 0.01/0.99].

The invention claimed is:

1. A spray mold remover, prepared by filling a bleaching composition in a container having a spraying means, the bleaching composition comprising (a) an alkali metal hypochlorite, (b) a cationic surfactant and (c) a compound represented by the formula (1):

$$X^1—O(AO)_n—X^2 \quad (1)$$

wherein, AO represents an alkyleneoxy group having 2 to 4 carbon atoms; n represents an average addition mole number of the alkyleneoxy group ranging from 5 to 150; $X^1$ and $X^2$ each represent a hydrogen atom, $—SO_3M$, or $—CH_2COOM$ (M represents an alkali metal atom), with the proviso that $X^1$ and $X^2$ do not represent hydrogen atoms at the same time;

wherein a molar ratio of the component (c) to the component (b) in the bleaching composition represented by (c)/(b) (when the component (c) has two $—SO_3M$ or $—CH_7COOM$ groups as $X^1$ and $X^2$, the mole number of the compound is multiplied by 2) is 1 or less.

2. The spray mold remover according to claim 1, wherein the component (b) in the bleaching composition is a cationic surfactant represented by the formula (2):

(2)

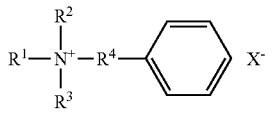

wherein, $R^1$ represents an alkyl group having 6 to 12 carbon atoms; $R^2$ and $R^3$ each independently represent an alkyl group having 1 to 3 carbon atoms; $R^4$ represents an alkylene group having 1 to 3 carbon atoms; and $X^-$ represents a counter ion.

3. The spray mold remover according to claim 1, wherein the bleaching composition further comprises (d) a tertiary amine oxide represented by the formula (3):

$$R^5R^6R^7N→O \quad (3)$$

wherein, $R^5$ represents a linear or branched alkyl group having 8 to 20 carbon atoms; and $R^6$ and $R^7$ each represent a linear or branched alkyl group having 1 to 3 carbon atoms.

4. The spray mold remover according to claim 1, wherein the bleaching composition further comprises (e) a hydrotrope agent having a benzene ring.

5. The spray mold remover according to claim 1, wherein the bleaching composition further comprises (f) a compound represented by the formula (4):

$$R^{11}COOM \quad (4)$$

wherein, $R^{11}$ represents a linear or branched alkyl group having 6 to 22 carbon atoms; and M represents a hydrogen, an alkali metal or an alkaline earth metal atom.

6. The spray mold remover according to claim 1, wherein the bleaching composition further comprises (g) an alkali metal hydroxide.

* * * * *